US007229257B2

(12) United States Patent
Ko et al.

(10) Patent No.: US 7,229,257 B2
(45) Date of Patent: Jun. 12, 2007

(54) HORIZONTAL TYPE COMPRESSOR

(75) Inventors: Hyun-Jun Ko, Gyungsangsam-Do (KR); Youn-Bong Han, Gyungsangsam-Do (KR)

(73) Assignee: LG Electronics Inc., Seoul (KR)

( * ) Notice: Subject to any disclaimer, the term of this patent is extended or adjusted under 35 U.S.C. 154(b) by 581 days.

(21) Appl. No.: 10/703,578

(22) Filed: Nov. 10, 2003

(65) Prior Publication Data

US 2004/0154330 A1 Aug. 12, 2004

(30) Foreign Application Priority Data

Feb. 7, 2003 (KR) ..... 10-2003-0007855
Feb. 7, 2003 (KR) ..... 10-2003-0007856

(51) Int. Cl.
*F04B 39/00* (2006.01)
*F04B 17/00* (2006.01)

(52) U.S. Cl. ..... 417/312; 417/410.3

(58) Field of Classification Search ..... 417/410.3, 417/312; 184/6.16; 418/63, 62, 154
See application file for complete search history.

(56) References Cited

U.S. PATENT DOCUMENTS 2,124,239 A * 7/1938 Smith ..... 417/372
2,137,962 A * 11/1938 Weiher ..... 417/363
2,306,608 A * 12/1942 Hubacker ..... 418/63
3,850,551 A * 11/1974 Gamache et al. ..... 417/410.3
4,518,330 A * 5/1985 Asami et al. ..... 418/63
4,640,669 A * 2/1987 Gannaway ..... 417/410.3
4,645,429 A * 2/1987 Asami et al. ..... 417/312
4,781,542 A * 11/1988 Ozu et al. ..... 417/369
4,884,956 A * 12/1989 Fujitani et al. ..... 418/15
5,222,885 A * 6/1993 Cooksey ..... 418/96
6,106,242 A * 8/2000 Sung ..... 417/312
6,116,877 A * 9/2000 Takeuchi et al. ..... 418/88
6,213,732 B1 * 4/2001 Fujio ..... 417/312
6,287,098 B1 * 9/2001 Ahn et al. ..... 418/63
6,302,665 B1 * 10/2001 Esumi et al. ..... 418/178
6,322,339 B1 * 11/2001 Mitsunaga et al. ..... 418/55.2
6,582,207 B2 * 6/2003 Matsumoto et al. ..... 417/410.1
6,893,237 B2 * 5/2005 Yamanaka et al. ..... 418/60

(Continued)

FOREIGN PATENT DOCUMENTS

JP 2-110290 U 4/1990

(Continued)

*Primary Examiner*—Michael Koczo
*Assistant Examiner*—Jessica Frantz
(74) *Attorney, Agent, or Firm*—Birch, Stewart, Kolasch & Birch, LLP

(57) ABSTRACT

A horizontal type compressor comprising: a differential pressure plate for dividing an inside of a casing into a high pressure chamber and a lower pressure chamber and thus maintaining an oil level of the high pressure chamber to be higher than that of the lower pressure chamber; and a lubricating unit for supplying oil stored in the high pressure chamber to each sliding part in the compressor and making the oil which finished a lubricating operation return to the high pressure chamber from the lower pressure chamber. The compressor smoothly supplies refrigerant oil and minimizes an amount of the refrigerant oil discharged outside the compressor, thereby prolonging a life of the compressor and increasing a reliability of the compressor. Also, the differential pressure plate and the muffler are integrally formed, thereby reducing a fabricating cost and reducing an assembling process.

10 Claims, 6 Drawing Sheets

U.S. PATENT DOCUMENTS 7,040,880 B2 * 5/2006 Hasegawa et al. ..... 418/60
2006/0171835 A1 * 8/2006 Dreiman et al. ..... 418/63

FOREIGN PATENT DOCUMENTS

JP 2-123297 A 5/1990
JP 04128591 A * 4/1992
JP 04164184 A * 6/1992

* cited by examiner

HORIZONTAL TYPE COMPRESSOR

This Nonprovisional application claims priority under 35 U.S.C. § 119(a) on Patent Application No(s). 10-2003-0007855 and 10-2003-0007856 filed in KOREA on Feb. 7, 2003, the entire contents of which are hereby incorporated by reference.

BACKGROUND OF THE INVENTION

1. Field of the Invention

The present invention relates to a horizontal type compressor, and more particularly, to a horizontal type compressor which can minimize an amount of refrigerant oil discharged outside a compressor.

2. Description of the Related Art

Generally, a hermetic compressor is divided into a rotary compressor, a reciprocating compressor, and a scroll compressor by a method for compressing a fluid.

The rotary compressor compresses a fluid in accordance with that a rolling piston revolves and rotates in a cylinder, which is divided into a horizontal type and a vertical type as an installation type.

FIG. 1 is a sectional view of a horizontal type compressor according to the conventional art.

The horizontal rotary compressor according to the conventional art comprises: a casing 102 having a predetermined hermetic space; a driving unit 104 mounted at a left side of the casing 102 for generating a rotation force; a compression unit 106 mounted at a right side of the casing 102 for compressing refrigerant by the rotation force generated from the driving unit 104; and a lubricating unit 140 for supplying oil stored in a lower surface of the casing 102 to each friction part in the compressor.

A first cover 110 and a second cover 108 are hermetically mounted at the right and left sides of the casing 102, respectively. Also, a suction pipe 112 for sucking refrigerant is connected to a lateral surface of the casing 102, and a discharge pipe 114 for discharging compressed refrigerant is connected to the second cover 108.

The driving unit 104 includes: a stator 116 fixed to an inside of the casing 102 and provided with a power from outside; a rotor 118 arranged in the stator 116 with a predetermined interval and rotated by being interacted with the stator 116; and a rotation shaft 120 fixed in the rotor 118 for transmitting a rotary force to the compression unit 106 by being rotated with the rotor 118.

The compression unit 106 includes: a main bearing 122 mounted in the casing 102 with a predetermined interval in order to rotatively support the rotation shaft 120 and a sub bearing 124; a cylinder 128 mounted between the main bearing 122 and the sub bearing 124 to form a compression chamber 126 and connected with the suction pipe 112; a rolling piston 130 rotatively to an outer circumference surface of an eccentric portion 132 formed at one side of the rotation shaft 120 and contacted to an inner surface of the compression chamber 126 for being rotated and revolved; and a vane (not shown) for dividing an inside of the compression chamber 126 into a high pressure chamber and a low pressure chamber.

A discharge port 136 for discharging refrigerant compressed in the compression chamber 126 is formed at the main bearing 122, and a muffler 138 for reducing noise of refrigerant discharged from the discharge port 136 is mounted at an upper surface of the main bearing 122.

The lubricating unit 140 includes: oil filled at a lower portion of the casing 102 with a predetermined level L; a refrigerant pipe 142 connected to one side of the sub bearing 124 for receiving a part of the refrigerant compressed in the compression chamber 126 and providing a supply pressure of the oil; and an oil pipe 144 connected to an oil passage (not shown) formed at the rotation shaft 120 for supplying oil to the oil passage by a pressure of refrigerant discharged through the refrigerant pipe 142. Oil supplied to the oil pipe 144 is transmitted to each sliding part in the compressor through the oil passage.

Also, oil which finished the lubricating operation is discharged to the second cover 108 through a clearance between the rotor 118 and the stator 116. At this time, a part of the oil is discharged with refrigerant through the discharge pipe 114 connected to the second cover 108.

Operations of the horizontal type compressor according to the conventional art will be explained.

First, if a power is applied to the stator 116, the rotor 118 is rotated by an interaction between the stator 116 and the rotor 118, so that the rotation shaft 120 is rotated with the rotor 118.

Then, the rolling piston 130 is rotated and revolved in the compression chamber 126, thereby compressing refrigerant sucked in the compression chamber 126 through the suction pipe 112. The refrigerant compressed in the compression chamber 126 is discharged through the discharge port 136, has reduced noise by passing the muffler 138, and passes a clearance between the rotor 118 and the stator 116, thereby being discharged through the discharge pipe 114 connected to the first cover 108.

Then, oil filled in a lower portion of the casing 102 is supplied to the oil pipe 144 by a pressure of refrigerant discharged to the refrigerant pipe 142 and supplied to each sliding part through the oil passage formed at the rotation shaft 120, thereby performing a lubricating operation.

Subsequently, a part of the oil which finished the lubrication operation drops to a lower portion of the casing 102, and another part passes the clearance between the rotor 118 and the stator 116, thereby being discharged outwardly through the discharge pipe 114.

In the horizontal rotary compressor according to the conventional art, the oil stored in the lower portion of the casing 102 is supplied to the respective sliding parts in the compressor by a pressure of refrigerant to perform the lubricating operation. Also, a part of the oil which finished the lubricating operation drops to the lower portion of the casing 102 and another part is discharged to an outside of the compressor through the discharge pipe 114 with the refrigerant, thereby generating abrasion at the respective sliding parts due to lack of refrigerant oil, thus reducing a life of the compressor, and lowering a reliability of the compressor.

Also, in case of installing an additional differential pressure plate which generates a pressure difference in the compressor so as to prevent the refrigerant oil from being effused, a fabrication cost is increased, an assembly process is complicated since a process to install the differential pressure plate is added to the assembly process, and a working efficiency is lowered.

SUMMARY OF THE INVENTION

Therefore, an object of the present invention is to provide a horizontal type compressor which can smoothly supply refrigerant oil by generating a pressure difference in a compressor by installing a differential pressure plate between a compression unit and a driving unit and minimize an amount of the refrigerant oil discharged to an outside of the compressor, thereby prolonging a life of the compressor and improving a reliability of the compressor.

Another object of the present invention is to provide a horizontal type compressor which can reduce a fabrication cost and assembly processes by integrally forming the differential pressure plate with a muffler.

To achieve these and other advantages and in accordance with the purpose of the present invention, as embodied and broadly described herein, there is provided a horizontal type compressor comprising: a casing in which a suction pipe and a discharge pipe are connected to each other; a driving unit mounted at one side of the casing for generating a rotation force; a compression unit mounted at the other side of the casing for compressing refrigerant by the rotation force generated from the driving unit; a differential pressure plate for dividing the casing into a high pressure chamber and a lower pressure chamber and thus maintaining an oil level of the high pressure chamber to be higher than that of the lower pressure chamber; and a lubricating unit for supplying oil stored in the high pressure chamber to each sliding part in the compressor and making the oil which finished a lubricating operation return to the high pressure chamber from the lower pressure chamber.

The casing is a cylindrical type having opened both sides, first and second covers are hermetically mounted to the opened both sides, respectively, and the suction pipe and the discharge pipe are respectively connected to lateral surfaces of the casing.

The differential pressure plate is integrally formed with a muffler which reduces noise of refrigerant discharged from the compression unit.

The differential pressure plate includes: a muffler portion for reducing noise of refrigerant by having a through hole inserted to a main bearing mounted to the compression unit and curved to have a predetermined space into which the refrigerant flows; and a differential pressure chamber for separating an inside of the compressor into a high pressure chamber and a lower pressure chamber by being integrally extended to an outer side of the muffler portion and attached to a surface of the main bearing with a plate form.

The muffler portion is curved with a convex form to have a predetermined space into which refrigerant flows, and a refrigerant outlet for discharging the refrigerant out is formed at one side of the through hole.

The differential pressure chamber is attached to the surface of the main bearing by being extended towards an outer circumference direction of the muffler portion, and includes an oil passage at one side thereof for passing oil and a refrigerant passage at the other side thereof for passing refrigerant.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Even though many embodiments can exist in the horizontal type compressor according to the present invention, the most preferred embodiment will be explained hereinafter.

Figure 1:
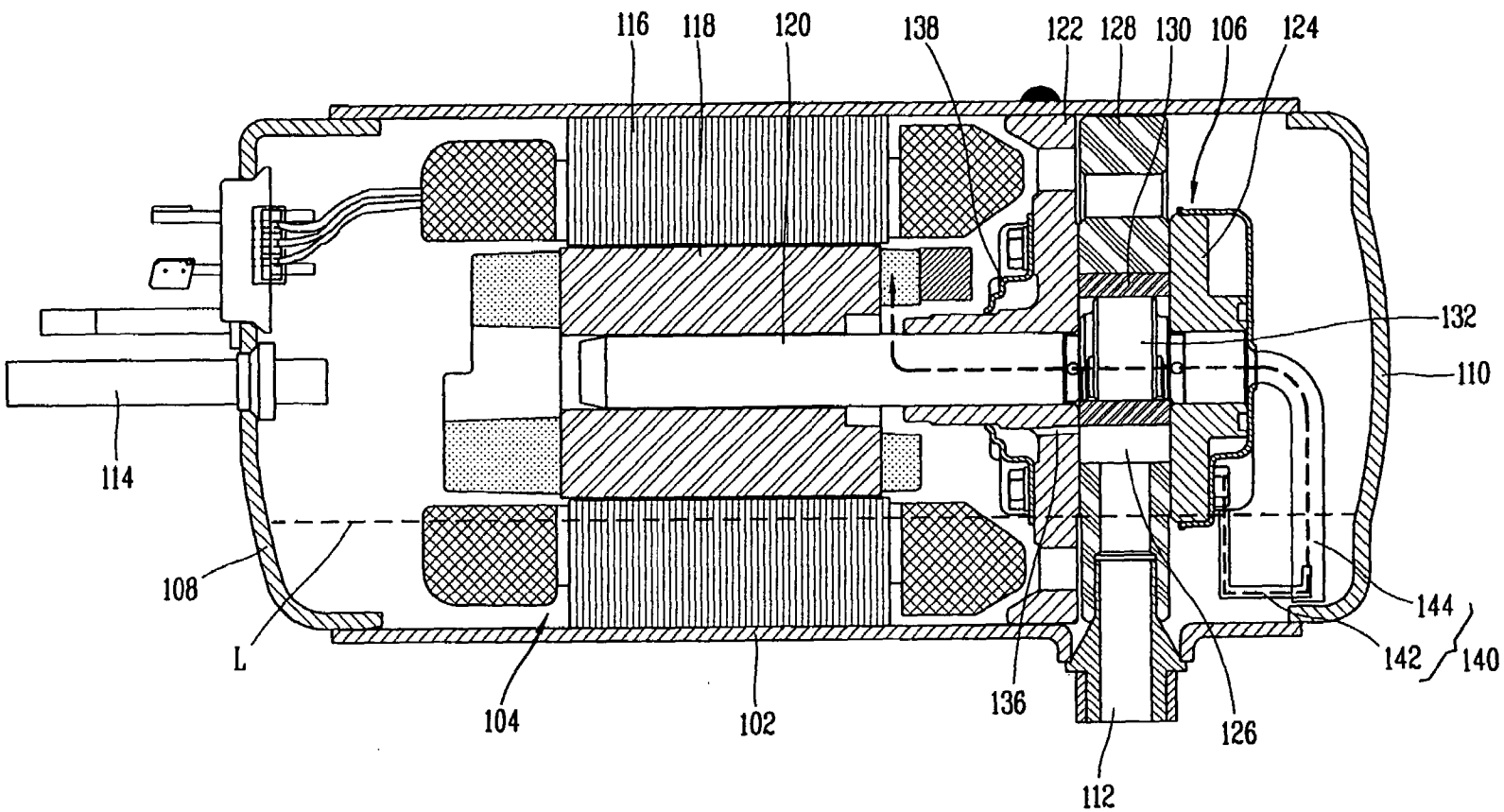
FIG. 1 CONVENTIONAL ART
FIG. 1 is a sectional view of a horizontal type compressor in accordance with the conventional art.
Figure 2:
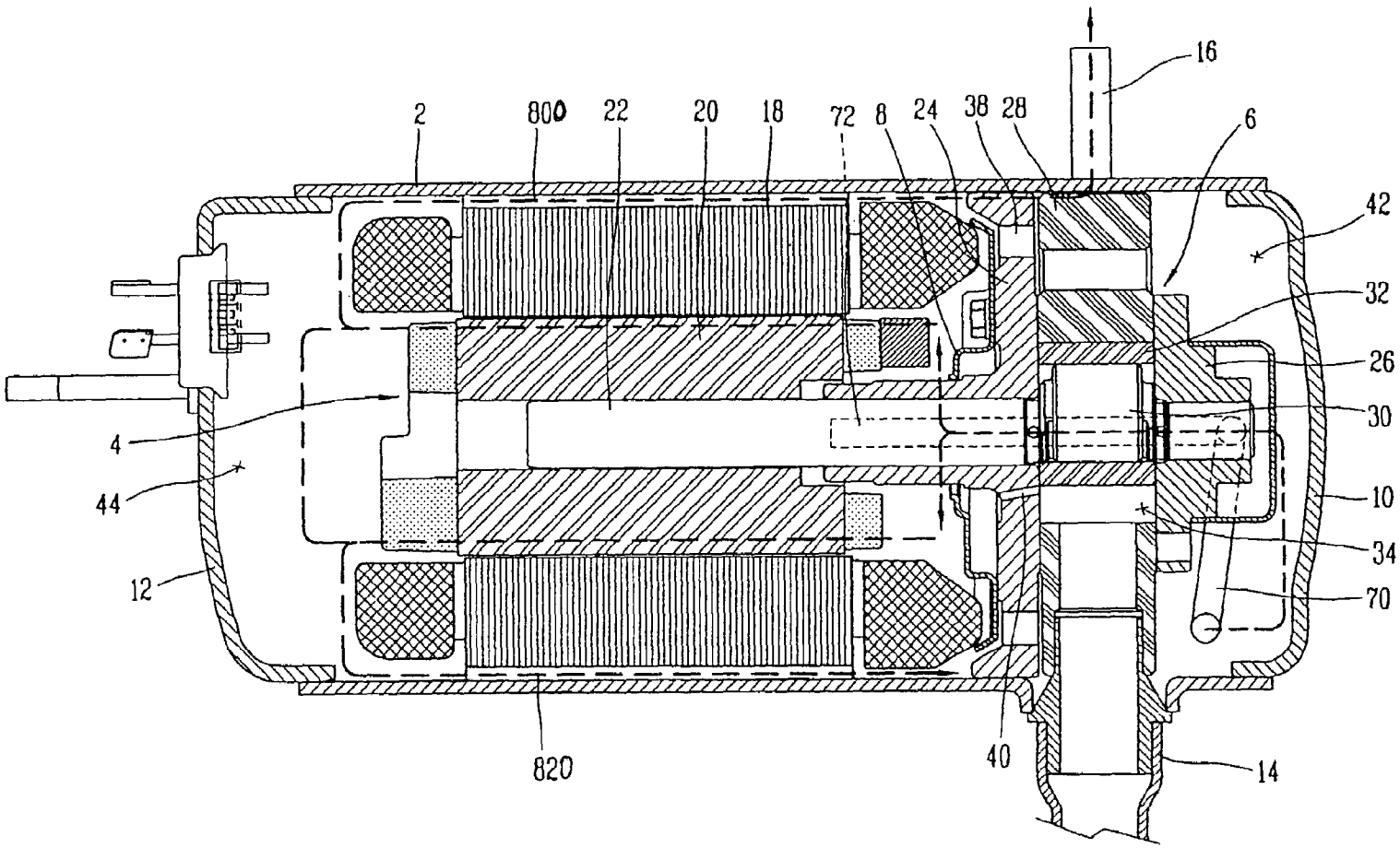
FIG. 2 is a sectional view of a horizontal type compressor according to the present invention.

FIG. 2 is a sectional view of the horizontal type compressor according to the present invention.

The horizontal type compressor according to the present invention comprises: a casing 2 having a hermetic space; a driving unit 4 mounted at one side of the casing 2 for generating a rotation force; a compression unit 6 mounted at the other side of the casing 2 for compressing refrigerant by the rotation force generated from the driving unit 4; and a lubricating unit for supplying refrigerant oil to each sliding part in the compressor.

Also, a differential pressure plate 8 for generating a pressure difference to divide an inside of the casing 2 into a high pressure chamber and a lower pressure chamber is installed between the compression unit 6 and the driving unit 4.

The casing 2 is a cylindrical type having opened both sides, first and second covers 10 and 12 are hermetically mounted to the opened both sides, respectively, and a suction pipe 14 for sucking refrigerant is connected to one side of the casing 2 and a discharge pipe 16 for discharging compressed refrigerant is connected to the other side of the casing 2.

The driving unit 4 includes: a stator 18 fixed to one side of the casing 2 and provided with a power from outside; a rotor 20 arranged in the stator 18 with a predetermined interval and rotated by being interacted with the stator 18; and a rotation shaft 22 fixed at a center of the rotor 20 for transmitting a rotary force to the compression unit 6.

The compression unit 6 includes: a cylinder 28 connected with the suction pipe 14 for forming a compression chamber 34; a rolling piston 32 rotatively installed to an outer circumference surface of an eccentric portion 30 formed at one side of the rotation shaft 22 and contacted to an inner surface of the compression chamber 34 for being rotated and revolved; and a vane (not shown) for dividing an inside of the compression chamber 34 into a high pressure chamber and a low pressure chamber.

A main bearing 24 for rotatively supporting the rotation shaft 22 and a sub bearing 26 for forming a part of the compression chamber 34 are mounted at both sides of the cylinder 28.

The main bearing 24 is provided with a plurality of through holes 38 for passing refrigerant and oil towards a circumference direction, and a discharge port 40 for discharging compressed refrigerant at one side thereof.

Also, a differential pressure plate 8 which serves as a muffler which reduces noise of refrigerant discharged to the discharge port 40 and divides inside of the compressor into a high pressure chamber 42 and a low pressure chamber 44 is mounted at a lateral surface of the main bearing 24.

Figure 3:
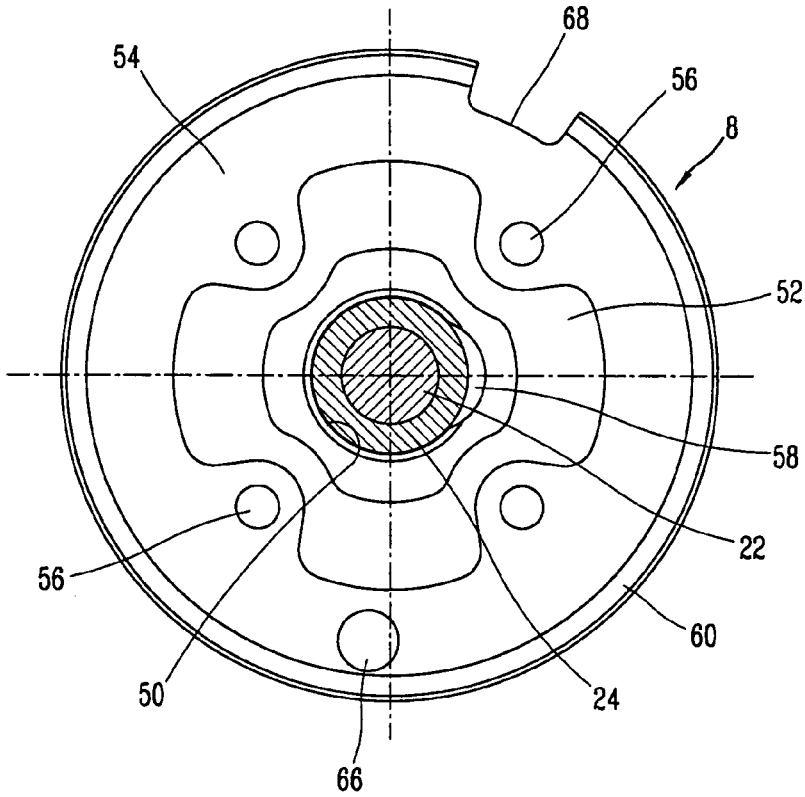
FIG. 3 is a front view of a differential pressure plate of the horizontal type compressor according to the present invention.
Figure 4:
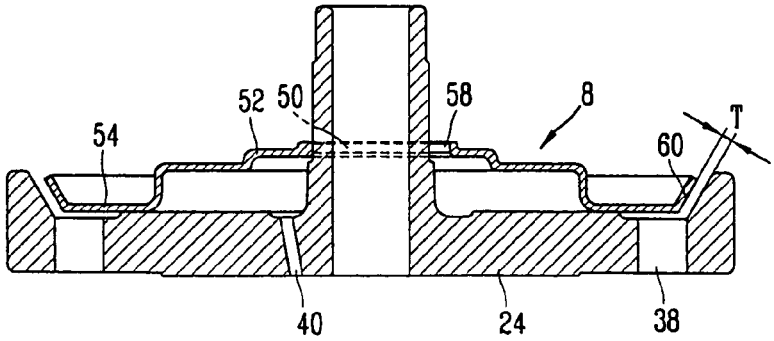
FIG. 4 is a sectional view of the differential pressure plate of the horizontal type compressor according to the present invention.

As shown in FIGS. 3 and 4, the differential pressure plate 8 is a disc shape curved many times towards a circumference direction to have a predetermined step and includes a muffler portion 52 for reducing noise of refrigerant discharged to the discharge port 40; and a differential pressure chamber 54 for dividing inside of the compressor into a high pressure chamber 42 and a lower pressure chamber 44 by being extended to an outer side of the muffler portion 52.

Herein, the muffler portion 52 is curved with a convex form to have a predetermined space into which refrigerant discharged to the discharge port 40 flows, and is provided with a through hole 50 to which the main bearing 24 is inserted at the center thereof. A refrigerant outlet 58 for discharging the refrigerant sucked in the muffler portion 52 is formed at one side of the through hole 50, and a bolt hole 56 bolt-engaged to a lateral surface of the main bearing 24 is formed with a predetermined interval towards a circumference direction of the through hole 50.

The differential pressure chamber 54 is extended to an outer side of the muffler portion 52 and attached to a surface of the main bearing 24 with a plate form. Also, a curved portion 60 curved to have a predetermined inclination angle towards a circumference direction is formed at an outer edge of the differential pressure chamber.

Herein, the curved portion 60 is arranged to have a predetermined clearance T at an edge of the main bearing 24 for passing refrigerant or oil. A width of the clearance T has a size to maintain a pressure between the high pressure chamber 42 and the lower pressure chamber 44 properly.

The differential pressure chamber 54 divides inside of the compressor into the high pressure chamber 42 and the lower pressure chamber 44, and thereby forms a high pressure at a part where the compression unit 6 is mounted and forms a low pressure at a part where the driving unit 4 is mounted.

An oil passage 66 for passing oil is formed at one edge of the differential pressure plate 54 and a refrigerant passage 68 for passing refrigerant is formed at the other edge of the differential pressure plate 54.

The lubricating unit is connected to the rotation shaft 22 located at the high pressure chamber 42 and includes an oil pipe 70 for sucking oil stored in the high pressure chamber 42 by a suction force generated by a centrifugal force of the rotation shaft 22; and an oil passage 72 formed at a center of the rotation shaft 22 towards a length direction for transmitting oil sucked into the oil pipe to each sliding part.

Figure 5:
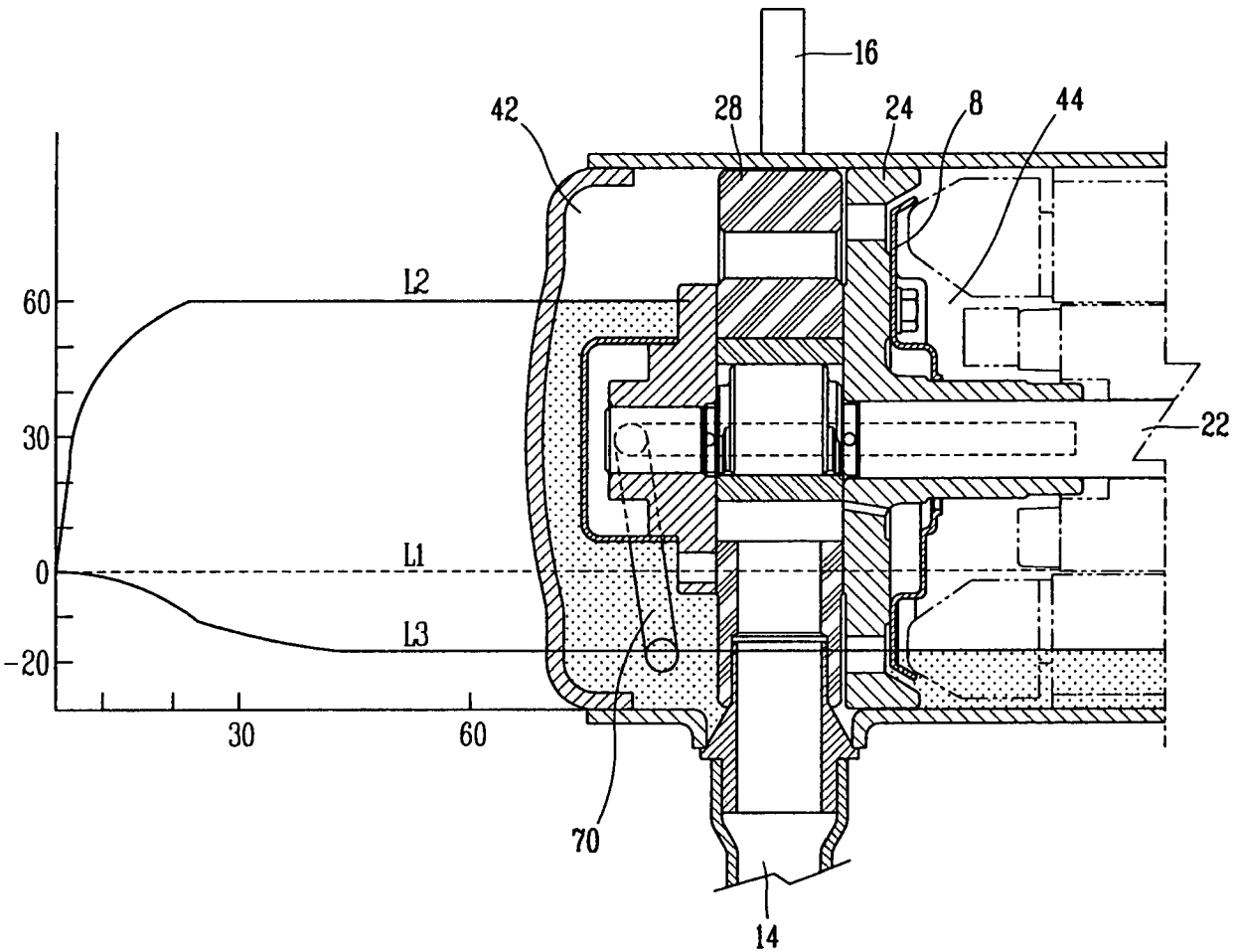
FIG. 5 is a graph showing an oil level of the horizontal type compressor according to the present invention.

Herein, since the inside of the compressor is divided into the high pressure chamber 42 and the lower pressure chamber 44 by the differential pressure plate 8, an oil level of the high pressure chamber 42 is formed to be higher than that of the lower pressure chamber 44. That is, as shown in FIG. 5, when an oil level L1 in a state that the compressor is stopped is supposed to be 0, an oil level L2 of the high pressure chamber 42 in a state that the compressor is driven is 60 mm and an oil level L3 of the lower pressure chamber 44 is −20 mm.

Operations of the horizontal type compressor according to the present invention will be explained.

First, if a power is applied to the stator 18, the rotor 20 is rotated by an interaction between the stator 18 and the rotor 20, so that the rotation shaft 22 is rotated with the rotor 20.

Then, the rolling piston 32 is rotated and revolved in the compression chamber 34, thereby compressing refrigerant sucked in the suction pipe 14 and then discharging through the discharge port 40. The refrigerant discharged to the discharge port 40 is introduced into the muffler portion 52 of the differential pressure plate 8 and thereby has reduced noise. Then, the refrigerant is discharged through the refrigerant discharge hole 58 formed at the differential pressure plate 8 and passes between the rotor 20 and the stator 18.

Then, the refrigerant filled in the high pressure chamber 42 by a centrifugal force of the rotation shaft 22 is sucked to the oil pipe 70 and transmitted to each sliding part through the oil passage 72 of the rotation shaft 22, thereby performing a lubricating operation. Subsequently, the oil which finished the lubrication operation passes a clearance between the stator 18 and the rotator 20 and then collides to an inner surface of the second cover 12.

At this time, the refrigerant and oil are separated from each other by colliding with the second cover 12. Also, the refrigerator flows to a refrigerant guide 800 formed between the casing 2 and the stator 18 and passes the refrigerant passage 68 formed at the differential pressure plate 8, thereby being discharged outwardly through the discharge pipe 16.

The oil separated from the refrigerant by colliding with the second cover 12 drops to a lower portion of the lower pressure chamber 44, and a predetermined amount of oil is introduced into the high pressure chamber 42 through the oil passage 66 formed at the differential pressure plate 8 along the oil guide 802 by a pressure difference between the high pressure chamber 42 and the lower pressure chamber 44, thereby maintaining an oil level difference between the high pressure chamber 42 and the lower pressure chamber 44 properly.

Figure 6:
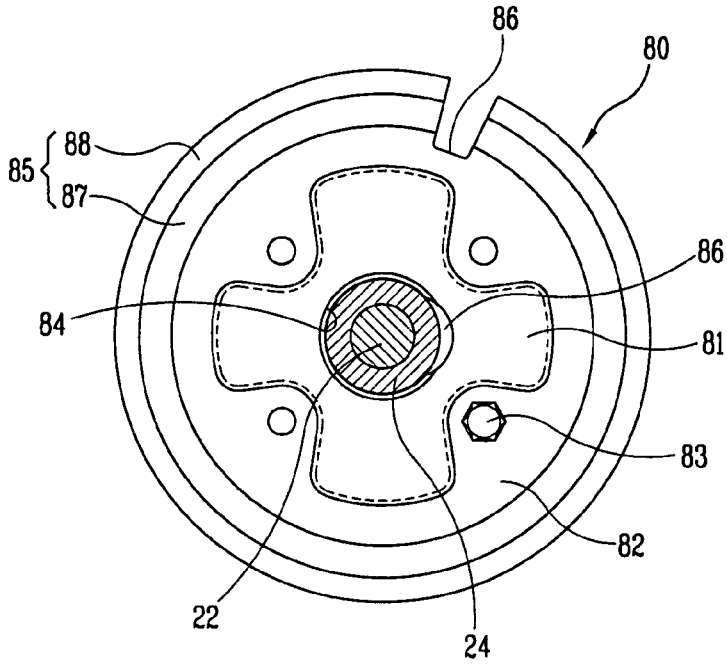
FIG. 6 is a front view of the differential pressure plate according to a second embodiment of the present invention.
Figure 7:
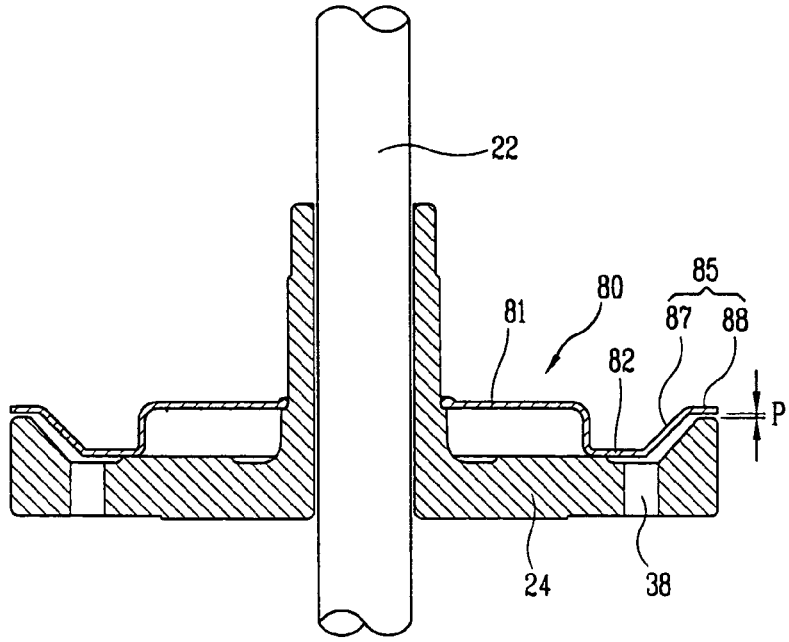
FIG. 7 is a sectional view of the differential pressure plate according to the second embodiment of the present invention.

FIG. 6 is a front view of the differential pressure plate according to the second embodiment of the present invention, and FIG. 7 is a sectional view of the differential pressure plate according to the second embodiment of the present invention.

The differential pressure plate 80 according to the second embodiment is composed of a muffler portion 81 having a predetermined space for reducing noise of refrigerant; and a differential pressure chamber 82 extended to an outer side of the muffler portion 81 for dividing inside of the compressor into the high pressure chamber 42 and a lower pressure chamber 44.

The muffler portion 81 is curved to have a predetermined space and engaged to a surface of the main bearing 24 by a bolt 83. Also, a through hole 84 into which the main bearing 24 is inserted is formed at the muffler portion 81 and a refrigerant outlet 86 is formed at one side of the through hole 84 for discharging refrigerant.

The differential pressure chamber 82 is extended to an outer side of the muffler portion 81 and attached to a front surface of the main bearing 24 to generate a pressure difference between the high pressure chamber 42 and the lower pressure chamber 44. Also, a curved step portion 85 is formed at an edge of the differential pressure chamber 82, and a predetermined clearance P for passing refrigerant is formed between the step portion 85 and the main bearing 24. Besides, a refrigerant passage 68 for passing refrigerant is formed at one side of the differential pressure plate 82.

The step portion is composed of a first step portion 87 in which an outer circumference surface of the differential pressure chamber 82 is curved to an upper direction with a predetermined angle, and a second step portion 88 curved with a flat form by being extended from the first step portion 87. At this time, the step portion 85 is formed to cover the edge of the main bearing 24 with a predetermined clearance P.

Since refrigerant passes through the clearance P between the step portion 85 and the main bearing 24, a pressure difference between the high pressure chamber 42 and the lower pressure chamber 44 is varied by a size of the clearance P. Accordingly, in order to maintain an oil level of the high pressure chamber 42 and the lower pressure chamber 44 properly, a size of the clearance P has to be optimized.

Like this, in the differential pressure plate 80 according to the second embodiment, the step portion 85 is curved two times by the first step portion 87 and the second step portion 88 and thus covers the outer circumference surface of the main bearing 24, thereby enhancing a pressure difference between the high pressure chamber 42 and the lower pressure chamber 44.

Figure 8:
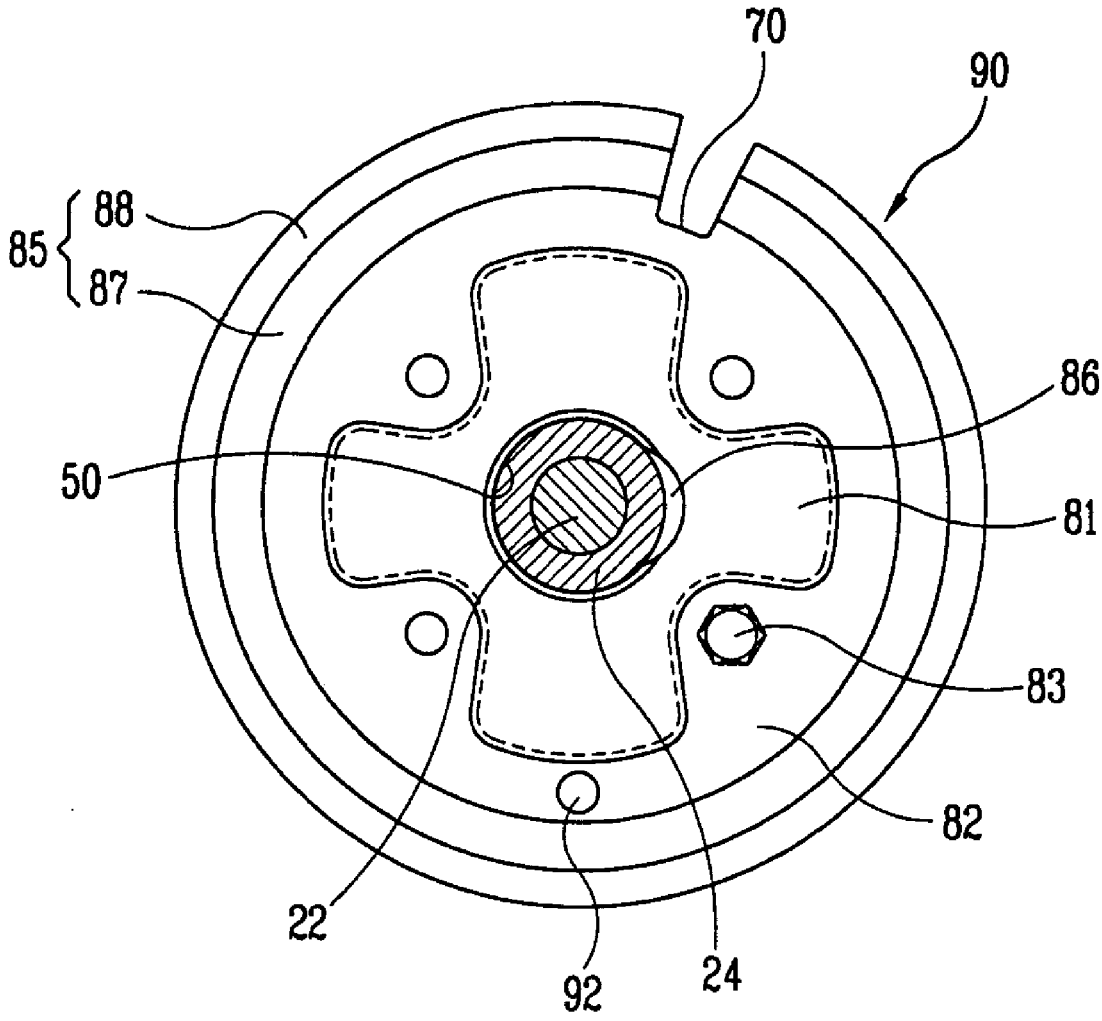
FIG. 8 is a front view of the differential pressure plate according to a third embodiment of the present invention.

FIG. 8 is a front view of the differential pressure plate according to the third embodiment of the present invention.

The differential pressure plate 90 according to the third embodiment of the present invention has the same structure with that according to the second embodiment except that an oil passage 92 through which oil in the lower pressure chamber moves to the high pressure chamber 42 is formed in the step portion 85.

That is, oil which finished the lubricating operation drops to a low surface of the lower pressure chamber 44, and oil in the lower pressure chamber 44 is moved to the high pressure chamber 42 not only through the clearance P between the step portion 85 and the main bearing 24 but also through the oil passage 92.

In the horizontal type compressor according to the present invention, the differential pressure plate is installed between the compression unit and the driving unit to divide the inside of the compressor into the high pressure chamber and the lower pressure chamber, the oil level difference between the high pressure chamber and the lower pressure chamber is properly maintained, and oil discharge through the discharge pipe is minimized by altering a location of the discharge pipe to a lateral surface of the casing, thereby smoothly lubricating each sliding part in the compressor, increasing a reliability of the compressor, and prolonging a life of the compressor.

Also, the compressor according to the present invention can reduce a fabrication cost and assembly processes by integrally forming the differential pressure plate with the muffler.

Also, since the differential pressure chamber forming a pressure difference in the differential pressure plate has a structure completely cover the upper surface of the main bearing, the pressure difference between the high pressure chamber and the lower pressure chamber can be enhanced and thus oil supply for lubrication can be smoothly performed.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A horizontal type compressor comprising:

a casing in which a suction pipe and a discharge pipe are connected to each other;

a driving unit mounted at one side of the casing for generating a driving force;

a compression unit mounted at the other side of the casing for compressing refrigerant by the driving force generated from the driving unit;

a differential pressure plate for dividing the casing into a high pressure chamber and a lower pressure chamber and thus maintaining an oil level of the high pressure chamber to be higher than that of the lower pressure chamber; and a lubricating unit for supplying oil stored in the high pressure chamber to each sliding part in the compressor and making the oil which finished a lubricating operation return to the high pressure chamber from the lower pressure chamber, wherein the differential pressure plate includes:

a muffler portion mounted at an upper surface of a main bearing and formed to have a predetermined space for reducing noise of refrigerant, and a differential pressure chamber is integrally extended from an outer side of the muffler portion and attached to an upper surface of the main bearing and has a predetermined clearance with an outer edge of the main bearing; and wherein a curved step portion is formed at an edge of the differential pressure chamber, and a predetermined clearance through which refrigerant passes is formed between the step portion and the main bearing.

2. The horizontal type compressor of claim 1, wherein the muffler portion is curved with a convex form to have a predetermined space into which refrigerant flows, and a refrigerant outlet for discharging the refrigerant out is formed.

3. The horizontal type compressor of claim 1, wherein the differential pressure chamber is extended towards an outer circumference direction of the muffler portion, and includes an oil passage at one side thereof for passing oil and a refrigerant passage at the other side thereof for passing refrigerant.

4. The horizontal type compressor of claim 1, wherein an oil level of the high pressure chamber in a state that the compressor is driven is 60 mm and an oil level of the lower pressure chamber is −20 mm, when an oil level in a state that the compressor is stopped is supposed to be 0 mm.

5. The horizontal type compressor of claim 1, wherein the lubricating unit is connected to a rotation shaft located at the high pressure chamber and includes:

an oil pipe for sucking oil stored in the high pressure chamber by a suction force generated by a centrifugal force of the rotation shaft; and an oil passage formed in the rotation shaft towards a length direction thereof for transmitting oil sucked into the oil pipe to each sliding part.

6. The horizontal type compressor of claim 1, wherein the step portion is curved with a predetermined angle towards an upper direction and again curved with a plate form, thereby covering an edge of the main bearing with a predetermined clearance.

7. The horizontal type compressor of claim 1, wherein the step portion includes:

a first step portion in which an outer circumference surface of the differential pressure chamber is curved to an upper direction with a predetermined angle; and a second step portion curved with a flat form by being extended from the first step portion, wherein a predetermined clearance is formed between the second step portion and the edge of the main bearing.

8. The horizontal type compressor of claim 1, wherein a refrigerant passage for passing refrigerant is formed at the differential pressure chamber.

9. The horizontal type compressor of claim 1, wherein an oil passage for moving oil in the low pressure chamber to the high pressure chamber is formed at the differential pressure chamber.

10. The horizontal type compressor of claim 1, wherein the differential pressure plate surrounds a rotation shaft and has a refrigerant outlet discharge hole adjacent to the rotation shaft.

* * * * *